US011465200B2

(12) United States Patent
Erny et al.

(10) Patent No.: US 11,465,200 B2
(45) Date of Patent: Oct. 11, 2022

(54) REFRACTORY RING STRUCTURE AND RELATED METHOD

(71) Applicant: Resco Products, Inc., Pittsburgh, PA (US)

(72) Inventors: Edward Leo Erny, Southgate, MI (US); Jason William Hebert, Hoover, AL (US)

(73) Assignee: RESCO PRODUCTS, INC., Pittsburgh, PA (US)

( * ) Notice: Subject to any disclaimer, the term of this patent is extended or adjusted under 35 U.S.C. 154(b) by 9 days.

(21) Appl. No.: 17/160,861

(22) Filed: Jan. 28, 2021

(65) Prior Publication Data

US 2022/0234100 A1 Jul. 28, 2022

(51) Int. Cl.

| | |
|---|---|
| ***B22D 41/02*** | (2006.01) |
| ***F27D 1/00*** | (2006.01) |
| ***F27D 1/04*** | (2006.01) |

(52) U.S. Cl.

CPC ..... *B22D 41/02* (2013.01); *F27D 1/0006* (2013.01); *F27D 1/0043* (2013.01); *F27D 1/04* (2013.01)

(58) Field of Classification Search

CPC ..... B22D 41/02; F27D 1/0006; F27D 1/0043; F27D 1/04

See application file for complete search history.

(56) References Cited

U.S. PATENT DOCUMENTS

| | | | | |
|---|---|---|---|---|
| 3,800,853 | A * | 4/1974 | Neumann | B22D 41/505 164/437 |
| 9,126,265 | B2 * | 9/2015 | Barrett | B22D 41/02 |
| 2002/0080846 | A1 | 6/2002 | Tanaka et al. | |

FOREIGN PATENT DOCUMENTS

| | | | |
|---|---|---|---|
| CN | 106524756 | A | 3/2017 |
| CN | 110280749 | A | 9/2019 |
| DE | 102007035452 | A1 | 1/2009 |
| EP | 3608440 | A1 | 2/2020 |
| JP | 10246579 | A * | 9/1998 |
| JP | 2000-288718 | A | 10/2000 |
| WO | 02/066915 | A1 | 8/2002 |

OTHER PUBLICATIONS

International Search Report and Written Opinion of the International Searching Authority for International Application No. PCT/US2022/013510 dated Mar. 23, 2022.

* cited by examiner

*Primary Examiner* — Scott R Kastler

(74) *Attorney, Agent, or Firm* — K&L Gates LLP

(57) ABSTRACT

A refractory ring structure for forming a section of an inner wall or liner of a metallurgical vessel is provided. The refractory ring structure comprises a continuous top surface; a continuous bottom surface; a continuous arcuate inner surface extending from the top surface to the bottom surface and defining a cavity; a continuous arcuate outer surface opposite the inner surface and extending between the top surface and the bottom surface; and a continuous protrusion or a plurality of protrusions extending from the inner surface for lifting the ring structure. The refractory ring structure comprises a heat resistant, refractory material suitable for use in the inner wall of a metallurgical vessel. Also provided herein are a metallurgical vessel comprising a refractory ring structure as disclosed herein, and a method for providing or replacing all or a section of a refractory inner wall or liner of a metallurgical vessel.

36 Claims, 6 Drawing Sheets

REFRACTORY RING STRUCTURE AND RELATED METHOD

BACKGROUND

Metallurgy most often requires heating and melting of metallic materials. Handling and transporting high temperature liquid or molten materials, such as molten metallic materials, requires special considerations and equipment. For example, molten metallic materials can be handled and transported in specialized metallurgical vessels. These vessels may include an outer steel shell and commonly are lined with one or more layers of refractory material which protect metal regions of the vessel from the heat of the molten metallic material disposed in the vessel. However, although the refractory material is heat-resistant, the material experiences wear over time and will require replacement.

SUMMARY

One aspect of the present disclosure is directed to a preformed refractory ring structure that can form a section of an inner wall of a metallurgical vessel. The refractory ring structure comprises a continuous top surface, a continuous bottom surface, a continuous arcuate inner surface extending from the top surface to the bottom surface and defining a cavity, and a continuous arcuate outer surface opposite the inner surface and extending between the top surface and the bottom surface. The refractory ring structure is configured to form all or a region of a refractory inner wall or liner of a metallurgical vessel when installed in the vessel. The inner surface comprises a plurality of (i.e., two or more) protrusions located intermediate the top surface and the bottom surface and extending a distance into the cavity. A plurality of spacings is defined between the protrusions of the plurality of protrusions. The refractory ring structure comprises a heat resistant, refractory material suitable for use in the inner wall of a metallurgical vessel.

A further aspect of the present disclosure is directed to a preformed refractory ring structure that can form a section of an inner wall of a metallurgical vessel. The refractory ring structure comprises a continuous top surface, a continuous bottom surface, a continuous arcuate inner surface extending from the top surface to the bottom surface and defining a cavity, and a continuous arcuate outer surface opposite the inner surface and extending between the top surface and the bottom surface. The refractory ring structure is configured to form all or a region of a refractory inner wall or liner of a metallurgical vessel when installed in the vessel. The inner surface comprises a continuous annular protrusion located intermediate the top surface and the bottom surface and extending a distance into the cavity. The refractory ring structure comprises a heat resistant, refractory material suitable for use in the inner wall of a metallurgical vessel.

Also provided herein is a method for providing or replacing a section of a refractory inner wall of a metallurgical vessel. The method comprises lifting a refractory ring structure into a cavity defined by components of a metallurgical vessel and positioning the refractory ring structure to form all or a region of a refractory inner wall or liner of a metallurgical vessel when installed in the vessel. The refractory ring structure comprises a continuous top surface, a continuous bottom surface, a continuous arcuate inner surface extending from the top surface to the bottom surface and defining the cavity, and a continuous arcuate outer surface opposite the inner surface extending between the top surface and the bottom surface. The refractory ring structure is configured to form all or a section of a refractory wall or liner of a metallurgical vessel when installed in the vessel. In certain non-limiting embodiments, the inner surface comprises a plurality of protrusions located intermediate the top surface and the bottom surface and extending a distance into the cavity, and a plurality of spacings are defined between the protrusions of the plurality of protrusions. The refractory ring structure is lifted into the cavity by contacting the protrusions with elements of a lifting apparatus. In certain other non-limiting embodiments, the inner surface comprises a continuous annular protrusion located intermediate the top surface and the bottom surface and extending a distance into the cavity. The refractory ring structure is lifted into the cavity by contacting the continuous protrusion with elements of a lifting apparatus.

It is understood that the inventions described in the present disclosure are not limited to the examples summarized in this Summary. Various other examples are described and exemplified herein.

BRIEF DESCRIPTION OF THE DRAWINGS

Various features of the embodiments described herein are set forth with particularity in the appended claims. The various embodiments, however, both as to organization and methods of operation, together with advantages thereof, may be understood in accordance with the following description taken in conjunction with the accompanying drawings as follows:

Corresponding reference characters indicate corresponding parts throughout the several views. The exemplifications set out herein illustrate various embodiments of the invention, in one form, and such exemplifications are not to be construed as limiting the scope of the invention in any manner.

DESCRIPTION OF CERTAIN NON-LIMITING EMBODIMENTS

Figure 1A:
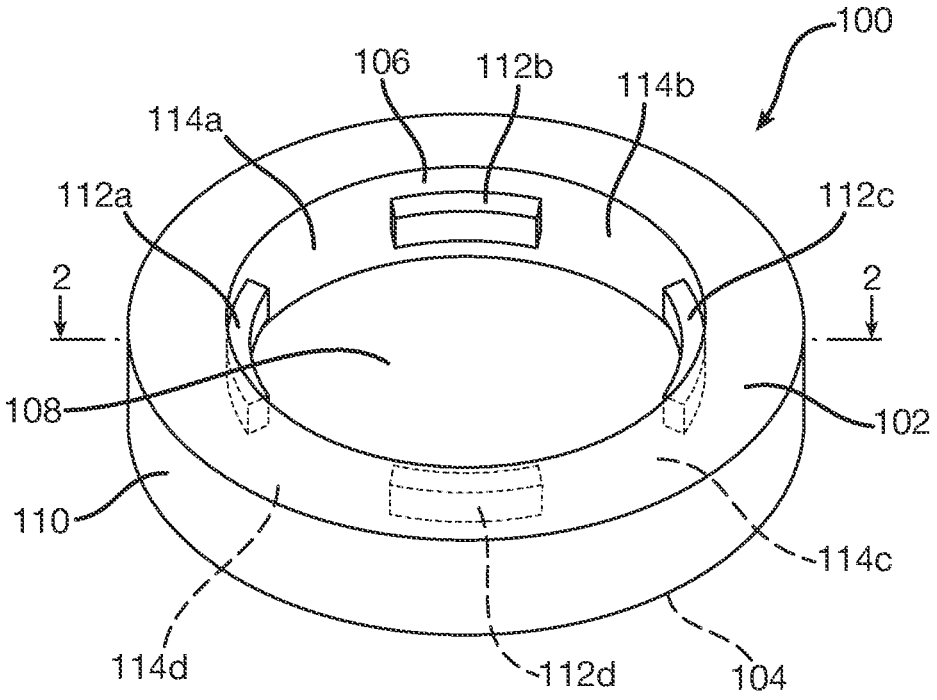
FIG. 1A is a perspective view of a non-limiting embodiment of a preformed refractory ring structure according to the present disclosure.

Before explaining various aspects of the present disclosure in detail, it should be noted that the illustrative examples are not limited in application or use to the details of construction and arrangement of parts illustrated in the accompanying drawings and description. The illustrative examples may be implemented or incorporated in other aspects, variations, and modifications, and may be practiced or carried out in various ways. Further, unless otherwise indicated, the terms and expressions employed herein have been chosen for the purpose of describing the illustrative examples for the convenience of the reader and are not for the purpose of limitation thereof. Also, it will be appreciated that one or more of the following described aspects, expressions of aspects, and/or examples, can be combined with any one or more of the other following described aspects, expressions of aspects, and/or examples.

Metallurgical vessels used to metallurgically treat or transport molten metallic materials (e.g., molten steel or other molten metals or alloys) are exposed to heat from the molten metallic material disposed within them. In order to allow such vessels to withstand that heat, the vessels can include an inner wall that is formed of refractory (e.g., heat-resistant) materials and that is disposed between a metal outer shell of the vessel and the cavity of the vessel that will hold the molten material. In certain embodiments, a vessel may include a refractory inner wall that includes only a single layer or liner of refractory material. In certain other embodiments, a vessel may include a refractory inner wall that includes both a first (e.g., outer) refractory layer or liner that contacts an inner surface of a metallic shell of the vessel, and a second (e.g., inner) refractory layer or liner that contacts or is in close proximity to the first refractory liner or layer and (when present) the molten metallic material.

As the refractory material in the wall/liner/layer corrodes, erodes, and otherwise wears over time, it is necessary to provide a new or replacement refractory liner or layer in a metallurgical vessel from time to time. The inventors of the present application have developed a unique preformed refractory ring structure that can be used as all or a portion of a refractory wall/liner/layer of a metallurgical vessel. As will be apparent from the disclosure herein, the design of the ring structure of the present disclosure provides several advantages over existing structures. For example, the ring structure disclosed herein can be easily lifted and positioned within a metallurgical vessel. For example, a lifting device may be lowered into certain non-limiting embodiments of a preformed refractory a ring structure according to the present disclosure and rotated into position so that elements of the lifting device oppose protrusions on an inner surface of the ring structure to lift the ring structure, without the need to extend or otherwise adjust a shape or size of the components of the lifting device. A lifting device may be lowered into certain other non-limiting embodiments of a preformed refractory ring structure according to the present disclosure and lifting arms or other load bearing components of the lifting device may be extended or otherwise manipulated to oppose a bottom surface of a continuous annular protrusion on an inner surface of the ring structure to lift the ring structure.

Additionally, in various non-limiting embodiments the preformed refractory ring structure according to the present disclosure benefits from having at least a minimum thickness at all points, providing a desired minimum temperature resistance at all points. For example, the ring structure may have at least a minimum thickness at all points, and only a thickness of one or more protrusions on an inner surface of the ring structure utilized to lift the ring structure need be greater than the minimum thickness required for desired temperature resistance.

In addition to providing a unique preformed refractory ring structure, the present disclosure also is directed to a method for providing or replacing a section of a refractory inner wall for a metallurgical vessel. Such method comprises using a lifting device and lifting a preformed refractory ring structure according to the present disclosure into the interior of a metallurgical vessel and positioning the ring structure so that it will form all or a portion of a refractory inner wall of the metallurgical vessel.

Referring to FIG. 1A, a perspective view of a non-limiting embodiment of a refractory ring structure 100 according to the present disclosure is shown. In various non-limiting embodiments, a ring structure according to the present disclosure may be cylindrical, conical, or may have some other simple or complex shape suitably adapted to fit within and form all or part of a wall or liner of a metallurgical vessel adapted for transporting and/or processing a molten material. As such, as used herein, "ring" does not necessarily mean perfectly circular or annular, but rather refers to a continuous bounded shape defining a central void therein. Again referring to FIG. 1A, refractory ring structure 100 can be used to form a section of a heat resistant inner wall of a metallurgical vessel. The vessel may be any suitable vessel used to contain molten metallic material for processing and/or transport. One non-limiting example of such a metallurgical vessel is a metallurgical ladle, but it will be understood that such an example is not exhaustive of all possible metallurgical vessels, and other possible metallurgical vessels with which the invention of the present disclosure may be used will be readily apparent to those having ordinary skill in the art. The refractory ring structure 100 can comprise a generally annular shape or, in various alternative embodiments, can have another shape that conforms to an interior region of a metallurgical vessel. With regard to the embodiment illustrated in FIG. 1A, the refractory ring structure 100 can comprise a continuous annular top surface 102 and a continuous annular bottom surface 104. The top surface 102 and the bottom surface 104 can be substantially axially aligned through their centers (e.g., concentric). In FIG. 1, the bottom surface 104 is disposed on an obscured portion of the ring structure and, therefore, is identified with dashed reference lines.

The refractory ring structure 100 can comprise a continuous arcuate inner surface 106 extending from the top surface 102 to the bottom surface 104. The inner surface 106 of the ring structure 100 illustrated in the accompanying figures will be in contact with molten metallic material when such material is present in the vessel. The inner surface 106 defines a cavity 108, and the cavity 108 can receive molten metallic material. Additionally, the cavity 108 can receive components of a lifting device (not shown) in order to allow the ring structure 100 to be moved into position (e.g., placed into position in a vessel).

The refractory ring structure 100 can comprise a continuous arcuate outer surface 110, opposite the inner surface 106, which extends between the top surface 102 and the bottom surface 104. The outer surface 110 can be configured to closely oppose a section of an inner surface of an outer refractory wall (not shown) of a metallurgical vessel when installed in the vessel.

In the embodiment shown in FIG. 1A, the inner surface 106 of the ring structure 100 can comprise a plurality of spaced-apart protrusions. For example, inner surface 106 can include spaced-apart protrusions 112*a-d*. The protrusions 112*a-d* are disposed intermediate the top surface 102 and the bottom surface 104 and extend a distance into the cavity 108 defined by the inner surface 106. The ring structure 100 of the embodiment of FIG. 1A includes four protrusions 112*a-d* distributed in a spaced-apart fashion uniformly around a circumference of the inner surface 106 at generally the same elevation between the top surface 102 and the bottom surface 104. However, it will be understood that other non-limiting embodiments of a ring structure according to the present disclosure may include greater than or less than four protrusions and, when present, multiple protrusions may be spaced apart and disposed about the inner surface 106 intermediate the top surface 102 and the bottom surface 104 in arrangements and/or positions different from those illustrated in the accompanying figures. A ring structure according to the present disclosure may include multiple spaced-apart protrusions, and the protrusions may be disposed in any suitable arrangement, with any suitable spacing between adjacent protrusions. The protrusions, e.g., 112*a-d*, can be of equal or unequal size and shape and may extend into the cavity 108 from the inner surface 106 the same distance or different distances.

Figure 1B:
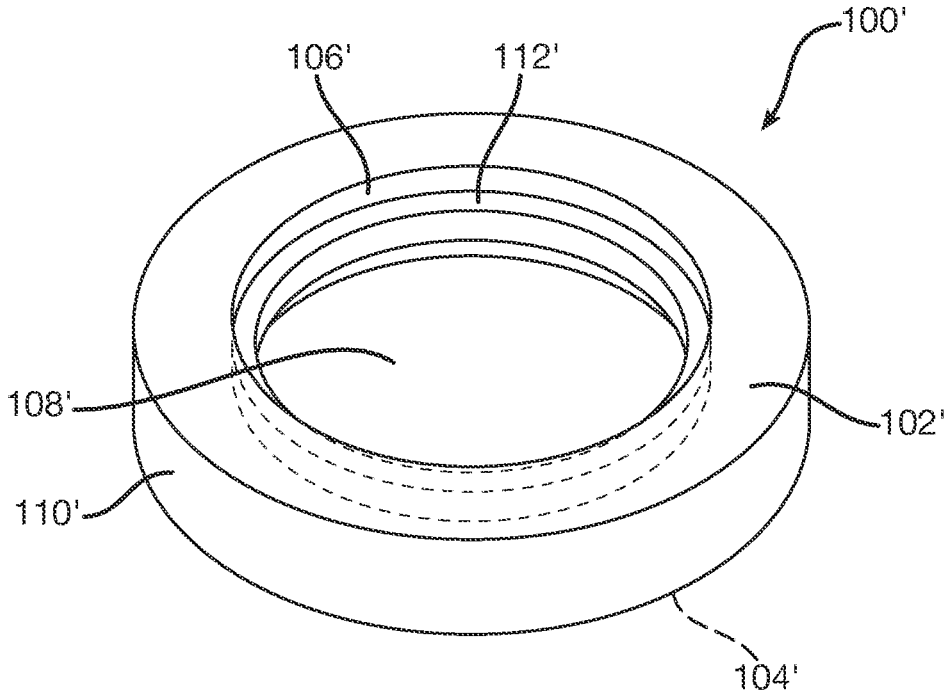
FIG. 1B is a perspective view of an alternative non-limiting embodiments of a preformed refractory ring structure according to the present invention.

As discussed herein, and as illustrated in FIG. 1B, in certain alternative non-limiting embodiments of a ring structure according to the present disclosure, the inner surface of the ring structure may include a continuous (e.g., annular) protrusion extending from the inner surface of the ring structure, without spaces defined between individual protrusions. With regard to the embodiment illustrated in FIG. 1B, the refractory ring structure 100' can comprise a continuous annular top surface 102' and a continuous annular bottom surface 104'. The top surface 102' and the bottom surface 104' can be substantially axially aligned through their centers (e.g., concentric). In FIG. 1B, the bottom surface 104' is disposed on an obscured portion of the ring structure and, therefore, is identified with dashed reference lines. Refractory ring structure 100' can comprise a continuous arcuate inner surface 106' extending from the top surface 102' to the bottom surface 104'. The inner surface 106' defines a cavity 108' that can receive molten metallic material. The refractory ring structure 100' can comprise a continuous arcuate outer surface 110', opposite the inner surface 106', which extends between the top surface 102' and the bottom surface 104'. The outer surface 110' can be configured to closely oppose a section of an inner surface of an outer refractory wall (not shown) of a metallurgical vessel when installed in the vessel.

Again referring to FIG. 1B, the cavity 108' can receive components of a lifting device (not shown) in order to allow the ring structure 100' to be moved into position (e.g., placed into position in a vessel). In the embodiment shown in FIG. 1B, the inner surface 106' of the ring structure 100' can comprise a continuous protrusion 112' disposed intermediate the top surface 102' and the bottom surface 104'. The continuous protrusion 112' extends a distance into the cavity 108'.

As will be apparent from the following description, one function of the plurality of protrusions (e.g., protrusions 112*a-d* in FIG. 1A) or the continuous protrusion (e.g., protrusion 112' in FIG. 1B) is to allow the ring structure to be lifted into a desired position. In various non-limiting embodiments, the protrusion(s) can be arranged so as to facilitate the lifting and positioning of the ring structure. With reference to FIG. 1A, for example, the protrusions 112*a-d* can be arranged so that when they are utilized to lift the ring structure 100, the weight of the ring structure 100 is distributed among the protrusions 112*a-d*, thereby optimizing the load on the protrusions 112*a-d*.

As further discussed below, the ring structure and the plurality of protrusions 112*a-d* or continuous protrusion 112' can be formed from, for example, one or more of: refractory bricks; a shape formed by casting a refractory castable material (referred to herein as a "precast" shape or section); or a shape formed by ramming, shotcreting, or guniting a monolithic refractory material (referred to herein as a "monolithic" shape or section). The refractory bricks, precast shapes, and/or monolithic shapes are suitable for forming all or a region of a refractory inner liner or wall of a metallurgical ladle or other metallurgical vessel used for receiving and processing and/or transporting molten material. As used herein, a "refractory brick" refers to an element or component composed of refractory (heat resistant) material or materials that may be assembled together with other such shapes, elements, or components and adhered together with a bonding agent to form all or a region of a refractory inner liner or wall of a metallurgical ladle or other metallurgical vessel used for receiving and processing and/or transporting molten material.

The plurality of protrusions 112*a-d* or the continuous protrusion 112' can be capable of supporting the weight of the ring structure 100, 100' during lifting or positioning thereof. In various non-limiting embodiments, the plurality of protrusions 112*a-d* or the continuous protrusion 112' can include one or more structural reinforcement members therein or thereon, or otherwise may be constructed so as to be reinforced and less likely to fail when used to lift the ring structure 100, 100'. A reinforcement included within or on a surface of a protrusion 112*a-d*, 112' can comprise a metal or metal alloy, for example, steel or stainless steel, or may comprise any other material that structurally reinforces the protrusion 112*a-d*, 112'. In various non-limiting embodiments, the structural reinforcement member is internally contained within or on a surface of the protrusion 112*a-d*, 112'.

The protrusions 112*a-d*, 112' can be positioned on the inner surface 106, 106' intermediate the top surface 102, 102' and the bottom surface 104, 104'. Referring to FIG. 1A, the distance between the top surface 102 and the bottom surface 104 is identified as h. No particular fraction of the distance h need be occupied by a protrusion 112*a-d*, and the protrusions 112*a-d* can be positioned at any vertical height less than h that is suitable for lifting the ring structure 100. Additionally, the protrusions 112*a-d* can be disposed at generally the same elevation or at different elevations above the bottom surface 104 along the inner surface 106. Furthermore, in various non-limiting embodiments, one or more of the protrusions 112*a-d* can be adapted to be contacted by a lifting device disposed in the cavity for lifting the ring structure 102. For example, a protrusion 112*a-d* can comprise a surface with shape and/or another characteristic suitable to receive a lifting member, or may have a shape or region that facilitates secure contact with an element of a lifting device. Likewise, referring to FIG. 1B, in non-limiting embodiments of a ring structure 100' according to the present disclosure including a continuous protrusion 112' on the inner surface 106', the protrusion 112' can be disposed at any suitable elevation on the inner surface 106' between the top surface 102' and the bottom surface 104' of the ring structure 100', can have any suitable vertical height, and also may be adapted in some way to facilitate being contacted by a lifting device.

As discussed above, in the embodiment of FIG. 1A including multiple protrusions, the protrusions 112*a-d* are spaced apart on the inner surface 106 of the ring structure 100 and, therefore, in various embodiments a plurality of spacings 114*a-d* may be defined between the protrusions 112*a-d*. In certain non-limiting embodiments, the spacings

114*a-d* are regions of the inner surface 106 that do not protrude into the cavity 108. In certain non-limiting embodiments, one or more of the plurality of spacings 114*a-d* has an increased wall thickness relative to adjacent regions to inhibit localized wear by erosion and/or corrosion. As shown in the embodiment of FIG. 1A, in certain non-limiting embodiments, the various regions of the inner surface 106 constituting the spacings 114*a-d* can be substantially the same radial distance from a central axis of the cavity 108 (e.g., the inner surface 106 can be substantially smooth in those regions). However, it will be understood that in various alternative embodiments of ring structures according to the present disclosure, spacings between individual protrusions may not be the same radial distance from a central axis of a cavity in the vessel and/or the vessel may not have a clearly defined central axis. For example, in certain non-limiting embodiments the vessel may include flat sections along its walls or have a dual radius design.

A ring structure according to the present disclosure can comprise a heat resistant, refractory material suitable for use in the inner wall of a metallurgical vessel. For example, the ring structure (e.g., ring structure 100, 100') can comprise refractory bricks joined together with a bonding agent, one or more precast shapes or sections, one or more monolithic shapes or sections, or a combination of two or more of refractory bricks, precast shapes or sections, and monolithic shapes or sections joined together with a bonding agent.

Figure 2:
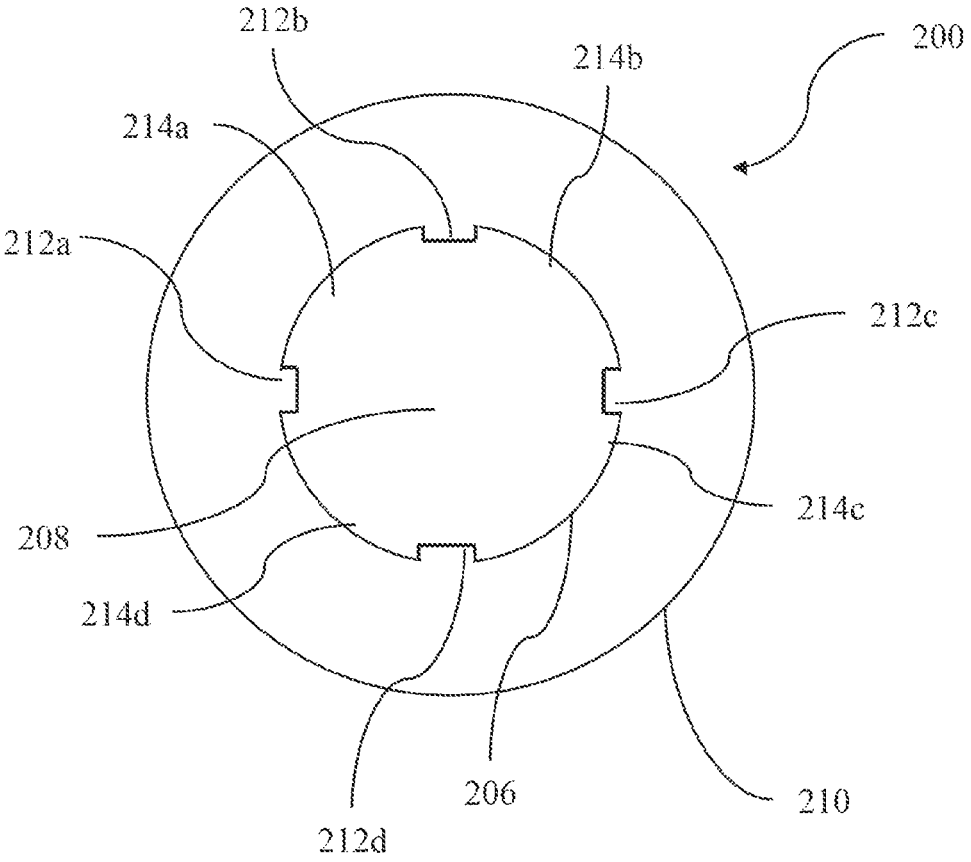
FIG. 2 is a top-down, cross-sectional view of the refractory ring structure of FIG. 1A, taken at mid-elevation through the protrusions 212*a-d*.

FIG. 2 is a cross-sectional top view of a ring structure 200 according to the present disclosure, taken at an intermediate elevation through protrusions 212*a-d*. Ring structure 100 of FIG. 1A and ring structure 200 of FIG. 2 may have the same configuration. Each ring structure 100, 200 comprises an inner surface 106, 206; an outer surface 110, 210; and a cavity 108, 208 defined by the inner surface 106, 206. The bottom surface 104 and top surface 102 are not visible in FIG. 2. Four spaced-apart protrusions 112*a-d* and 212*a-d* are shown in each view, along with four spacings 114*a-d* and 214*a-d* defined between the protrusions 112*a-d*, 212*a-d*.

Figure 3B:
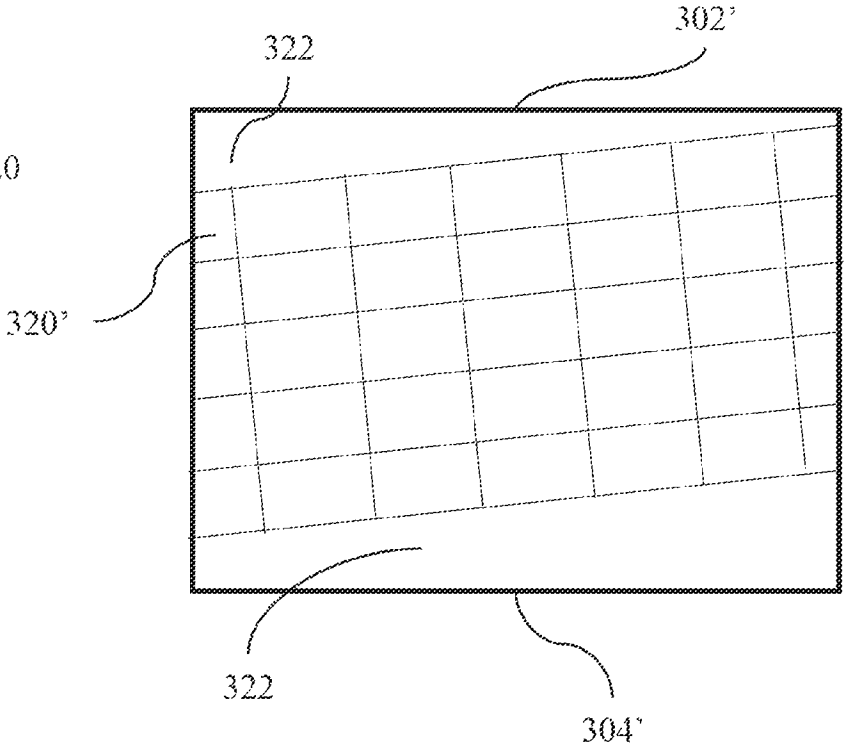
FIG. 3B is a view of a region of an inner surface of a non-limiting embodiment of a refractory ring structure according to the present disclosure wherein refractory bricks are in a closed ring and spiral arrangement.
Figure 3A:
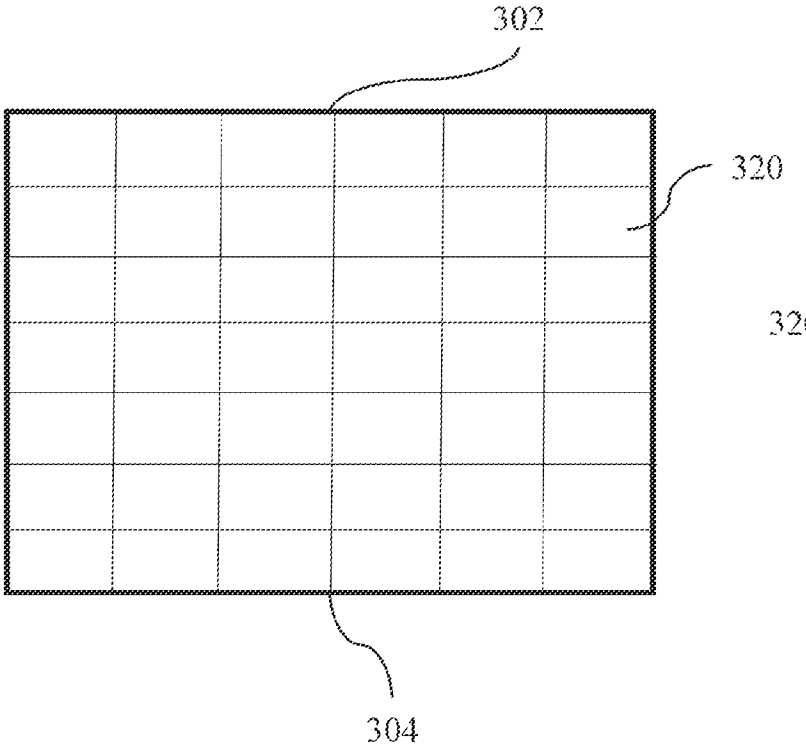
FIG. 3A is a view of a region of an inner surface of a non-limiting embodiment of a refractory ring structure according to the present disclosure wherein refractory bricks are in a closed ring arrangement.

FIGS. 3A and 3B each show flattened sections of non-limiting embodiments of refractory ring structures according to the present disclosure. Protrusions are not shown in FIGS. 3A and 3B. FIGS. 3A and 3B are marked to identify the top surfaces 302, 302' and the bottom surfaces 304, 304' of the illustrated flattened sections of the ring structure, and refractory bricks 320, 320' forming all or part of the illustrated sections are shown. The refractory bricks 320 of FIG. 3A are shown disposed in a "straight closed ring" pattern in which the top and bottom surfaces of the bricks 320 are generally parallel with the top surface 302 and bottom surface 304 of the ring structure section. The refractory bricks 320' of FIG. 3B are shown in a "spiral" (e.g., helical) arrangement in which the top and bottom surfaces of the bricks 320' are not parallel with the top surface 302' and bottom surface 304' of the illustrated section of the ring structure. FIG. 3B additionally shows that one or more precast shapes or sections, monolithic shapes or sections, and/or refractory brick sections 322' of refractory material may form a part of the ring structure, and in various embodiments one or more such refractory brick sections, precast shapes or sections, and monolithic shapes or sections could be included with one or more ring structure sections formed of refractory bricks adhered together in, for example, a closed ring arrangement, a spiral arrangement, or a combination of a closed ring arrangement and a spiral arrangement.

Figure 4C:
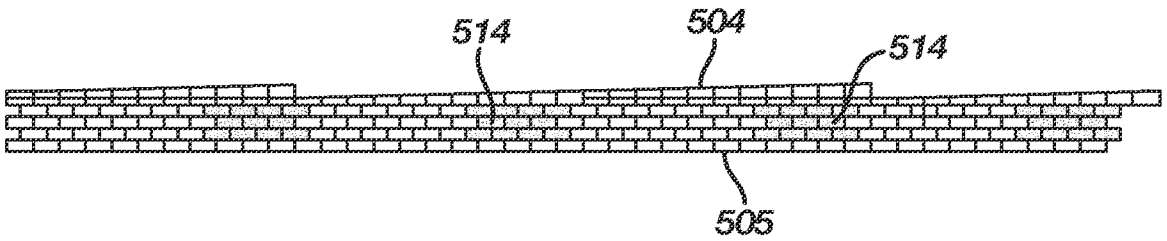
FIGS. 4A-C are views of an alternative non-limiting embodiment of a refractory ring structure according to the present disclosure wherein refractory bricks are in a closed ring arrangement with a top course of bricks forming a ramp region.
Figure 4A:
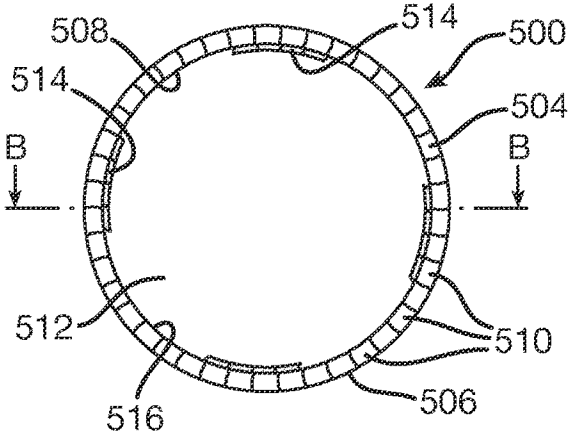
Figure 4B:
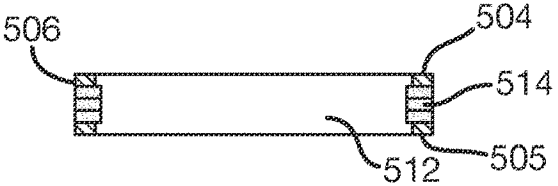

FIGS. 4A-C illustrates an alternative arrangement of refractory brick in a non-limiting embodiment of a preformed ring structure 500 according to the present disclosure. FIG. 4A is a top view of ring structure 500. FIG. 4. B is a sectional view of taken through the wall of ring structure 500 taken along line A-A in FIG. 4A, which passes through two protrusions 514. FIG. 4C is a flattened view of the ring structure 500 showing the individual refractory bricks forming the ring structure 500. Ring structure 500 includes continuous top surface 504, continuous bottom surface 505, arcuate outer wall 506, and arcuate inner wall 508 enclosing void 512. Inner wall 508 includes four evenly spaced protrusions 514 extending a distance into the void 512 and separated by spacings 516. As will be seen in FIG. 4C, all be the top layer of refractory bricks in ring structure 500 are disposed in a closed ring arrangement, while the top layer of refractory bricks include angled top surfaces and thereby form a ramp on the top surface 504 of the ring structure. As best shown in FIG. 4B, certain of the refractory bricks have an increased thickness and protrude from the arcuate inner surface 508 into the void 512, thereby forming protrusions 514.

It will be understood that any section of the refractory brick regions shown in FIGS. 3A, 3B, and 4A-C could be replaced by a precast shape or section, or a monolithic shape or section. Thus, various non-limiting embodiments of a ring structure according to the present disclosure may be composed entirely of refractory bricks adhered together, may be composed entirely of precast and/or monolithic shapes or sections, or may include one or more regions of refractory bricks and one or more regions of precast shape(s) or section(s) and/or monolithic shape(s) or section(s).

Figure 5:
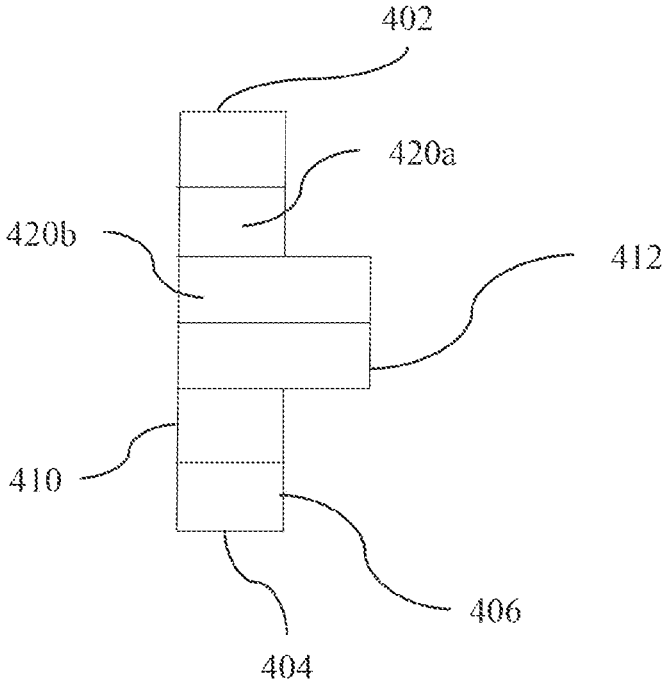
FIG. 5 is a cross-sectional view of a region of a non-limiting embodiment of a refractory ring structure according to the present disclosure showing individual refractory bricks forming a protrusion.

In certain non-limiting embodiments of a ring structure according to the present disclosure in which refractory bricks form all or one or more sections of the ring structure, protrusions formed on the inner surface of the ring structure can be comprised of refractory brick. FIG. 5 illustrates a cross-section taken radially through the wall of a non-limiting embodiment of a ring structure according to the present disclosure including protrusion 412. The ring structure comprises top surface 402, bottom surface 404, outer surface 410, and inner surface 406. The ring structure shown in FIG. 5 includes refractory bricks 420*a* having a first thickness, refractory bricks 420*b* having a second thickness and adjacent to bricks 420*a*, and wherein the second thickness is greater than the first thickness. Although not shown in FIG. 5, refractory bricks having a third thickness, intermediate the first and second thicknesses, may form a region of the ring structure adjacent to refractory bricks 420*b* to provide enhanced resistance against localized wear from erosion and/or corrosion. As will be apparent from FIG. 5, the difference in thickness between bricks 420*a* and 420*b* creates protrusion 412 extending from the inner surface 406, formed by bricks 420*b*. It will be understood that in various non-limiting embodiments of a ring structure according to the present disclosure including refractory brick and multiple protrusions on an inner surface of the ring structure, one or more of the multiple protrusions may be comprised of refractory brick. It will also be understood that in various non-limiting embodiments of a ring structure according to the present disclosure including refractory brick and a continuous protrusion on an inner surface of the ring structure, all or one or more regions of the continuous protrusion may be comprised of refractory brick.

Alternatively, protrusions extending from the inner surface of a ring structure according to the present disclosure may be formed from one or more precast and/or monolithic shapes or sections rather than from refractory bricks. If needed, the one or more precast and/or monolithic shapes or sections forming a protrusion can be reinforced in a manner suitable to bear the load to which the protrusion is subjected when lifting and moving the ring structure. For example, a precast or monolithic shape or section forming all or part of a protrusion may include one or more reinforcing members comprised of metal and/or another material within or on a precast and/or monolithic shape or section.

When refractory bricks are employed in a ring structure according to the present disclosure, the bricks can comprise any refractory material suitable to resist the heat of molten metallic material disposed within the cavity of the ring structure. Those with ordinary skill will be able to select suitable refractory brick types for use in ring structures according to the present disclosure based on the particular intended application. For example, as is known in the art, refractory bricks commonly used to line metallurgical vessels may include materials with constituents such as $Al_2O_3$, $SiO_2$, MgO, CaO, $Cr_2O_3$, magnesia alumina spinel, zirconium oxide, zircon, and various forms of carbon.

In various embodiments of a refractory ring structure according to the present disclosure comprising refractory bricks, the bricks may be held together with a bonding agent. Also, in various embodiments of a refractory ring structure including refractory bricks and one or more precast and/or monolithic shapes or sections, a bonding agent may be used to hold together the various regions, shapes, or sections and form the ring structure. If present, a bonding agent can comprise any compound such as, for example, a glue or adhesive, suitable to adhere refractory bricks and/or precast and/or monolithic shapes or sections together and to inhibit or prevent movement of the bricks, precast shapes or sections, and/or monolithic shapes or sections relative to one another. In certain non-limiting embodiments, the bonding agent can comprise one of a two-component epoxy compound, a refractory mortar, or other suitable adhesive. Persons having ordinary skill will be able to identify and use, without undue effort, a suitable bonding agent for use in various embodiments of a ring structure according to the present disclosure.

When precast shapes or sections and/or monolithic shapes and/or sections comprise all or a part of a ring structure according to the present disclosure, the material comprising the shapes or sections can be formed from any refractory material suitable to form all or a region of an inner refractory liner of a metallurgical vessel and which can resist the heat from a molten metallic material disposed within the vessel. For example, the precast or monolithic shapes or sections can be formed from a refractory castable or other monolithic refractory materials that may include, for example, one or more of $Al_2O_3$, $SiO_2$, MgO, CaO, $Cr_2O_3$, magnesia alumina spinel, zirconium oxide, zircon, and various forms of carbon as constituents. As examples, cement bonded castable and cement-free castable products can be used. Commercially available castable refractory material products include, for example, UNIFORM 90 ARS™, UNIFORM 94™, EZ EST 95 PC™, and UNIFORM 97™ castable refractory materials available from Resco Products, Inc., of Pittsburgh, Pa. USA.

When a precast shapes or sections and/or monolithic shapes or sections are used to form all or part of a ring structure according to the present disclosure, more than one precast and/or monolithic shape or sections can be present. For example, when the entire or large portions of a ring structure according to the present disclosure include precast or monolithic shapes or sections, multiple such shapes or sections may be present in the single ring structure. In such case, for example, the multiple shapes or sections can be joined together with a bonding agent such as, for example, the bonding agents described herein or other suitable bonding agents known to those having ordinary skill, to form the ring structure. Also, if both one or more sections formed of refractory bricks and one or more precast and/or monolithic shapes or sections are present in a ring structure according to the present disclosure, a suitable bonding agent can be used to connect together the two or more sections into the ring structure.

The present disclosure also contemplates a method of making a ring structure according to the present disclosure in which all or a region of the ring structure is comprised of one or more monolithic shape or section. As discussed above, the monolithic shape or section may be formed by ramming, shotcreting, or guniting a refractory material suitable for application the particular one of those techniques to form the shape or section. In certain non-limiting embodiments of a method of forming a ring structure according to the present disclosure, the monolithic shape or section may be pre-made and then assembled into the ring structure along with other regions of the ring structure comprising refractory bricks and/or a precast shape or section. In certain other non-limiting embodiments of a method of forming a ring structure according to the present disclosure, regions of the ring structure comprising refractory brick and/or precast shapes or sections can be assembled together so that one or more openings or gaps remain in the ring structure, and a monolithic shape or section is formed in an opening or gap using a ramming, shotcreting, and/or guniting technique, thereby filling the opening or gap. In this way, a monolithic shape or section can be formed in situ when making the ring structure.

The present disclosure also is directed to a metallurgical ladle or another metallurgical vessel including at least one ring structure according the present disclosure, such as, for example, ring structure 100, 100', or 200 described herein. The ring structure can form at least a portion of an inner refractory wall or liner of the metallurgical vessel. In various non-limiting embodiments, a metallurgical vessel according to the present disclosure may include a refractory inner wall or liner including a plurality of (i.e., two or more) ring structures according to the present disclosure (for example, ring structures 100, 100' and/or 200). In various non-limiting embodiments of a vessel including two or more ring structures according to the present disclosure, the two more ring structures according to the present disclosure may be stacked to form all or part of an inner refractory wall or liner in a metallurgical vessel. In various non-limiting embodiments of a vessel including two or more ring structures according to the present disclosure, the two or more ring structures can be joined together with a bonding agent (e.g., an adhesive or refractory mortar) as described herein or may be positioned together without the use of binding agent.

The present disclosure also is directed to a method for providing or replacing a section of a refractory inner wall/liner of a metallurgical ladle or another metallurgical vessel. The method can comprise lifting and positioning a refractory ring structure having a construction according to the present disclosure into a cavity defined by components of a metallurgical vessel, and positioning the refractory ring structure to form at least a portion of a refractory inner wall/liner of the metallurgical vessel. Lifting the ring structure can comprise contacting one or more protrusions formed on the inner surface of the ring structure with a mechanical lifting device for lifting and positioning the ring structure, and lifting the refractory ring structure via the protrusions. For example, in certain non-limiting embodiments of a refractory ring structure according to the present disclosure including multiple (i.e., two or more) protrusions on an inner wall thereof, lifting the refractory ring structure can comprise contacting or engaging a surface of each of one, two, or more of the protrusions with elements of a mechanical lifting device, and exerting a force on the protrusions and the ring structure sufficient to transport the ring structure to, and suitably position the ring structure within, a metallurgical vessel. Likewise, in certain non-limiting embodiments according to the present disclosure including a continuous protrusion on an inner surface thereof, lifting the ring structure can comprise contacting or engaging a surface of the continuous protrusion with elements of a lifting device, and exerting a force on the protrusion and the ring structure sufficient to transport the ring structure to, and suitably position the ring structure within, a metallurgical vessel. In certain non-limiting embodiments, one or more of the multiple protrusions or the continuous protrusion can include a surface that is not flat and is adapted to be contacted by a lifting device. For example, the surface may include one or more notches or other features to facilitate centering or other proper positioning of the lifting device on the surface.

Various non-limiting and non-exhaustive aspects of the subject matter described herein are set out in the following examples.

Example 1

A refractory ring structure for forming a section of an inner wall of a metallurgical vessel, the refractory ring structure comprising:

a continuous top surface;

a continuous bottom surface;

a continuous arcuate inner surface extending from the top surface to the bottom surface and defining a cavity; and a continuous arcuate outer surface opposite the inner surface and extending between the top surface and the bottom surface;

wherein the inner surface comprises a plurality of protrusions intermediate the top surface and the bottom surface and extending a distance into the cavity;

wherein a plurality of spacings are defined between the protrusions of the plurality of protrusions; and wherein the refractory ring structure comprises a heat resistant, refractory material suitable for use in the inner wall of a metallurgical vessel.

Example 2

The refractory ring structure of Example 1, wherein the ring structure includes at least two protrusions.

Example 3

The refractory ring structure of Example 1 or 2, wherein the protrusions of the plurality of protrusions are disposed along the inner wall at generally the same elevation above the annular bottom surface.

Example 4

The refractory ring structure of any of Examples 1-3, wherein each protrusion of the plurality of protrusions is adapted to be contacted by a lifting device disposed in the cavity for lifting the refractory ring structure.

Example 5

The refractory ring structure of any of Examples 1-4, wherein at least one protrusion of the plurality of protrusions is reinforced.

Example 6

The refractory ring structure of any of Examples 1-5, wherein at least one protrusion of the plurality of protrusions comprises an internal reinforcing member.

Example 7

The refractory ring structure of any of Examples 1-6, wherein at least one protrusion of the plurality of protrusions comprises a metallic reinforcing member.

Example 8

The refractory ring structure of any of Examples 1-7, wherein the refractory ring structure comprises refractory bricks joined together with a bonding agent.

Example 9

The refractory ring structure of Example 8, wherein the bonding agent is a two-component epoxy compound, a refractory mortar, or other suitable adhesive.

Example 10

The refractory ring structure of any of Examples 8-9, wherein the refractory bricks are disposed in one of a spiral arrangement or a closed ring arrangement.

Example 11

The refractory ring structure of any of Examples 1-10, wherein at least one protrusion of the plurality of protrusions is formed by one or more refractory bricks protruding from the inner surface into the cavity.

Example 12

The refractory ring structure of any of Examples 1-11, wherein at least one protrusion of the plurality of protrusions is formed by one or more refractory bricks comprising a thickness dimension greater than a thickness dimension of adjacent refractory bricks in the refractory ring structure.

Example 13

The refractory ring structure of any of Examples 1-12, wherein the refractory ring structure comprises refractory bricks comprising of one or more of $Al_2O_3$, $SiO_2$, MgO, CaO, $Cr_2O_3$ and various forms of carbon as major constituents, and wherein the refractory bricks are joined together with a bonding agent.

Example 14

The refractory ring structure of any of Examples 8-13, wherein at least one of the refractory bricks comprising the protrusions of the plurality of protrusions is structurally reinforced.

Example 15

The refractory ring structure of any of Examples 1-7, wherein the refractory ring structure comprises a precast shape or section and/or a monolithic shape or section.

Example 16

The refractory ring structure of any of Examples 1-15, wherein the refractory ring structure comprises a plurality of precast and/or monolithic shapes or sections arranged within the refractory ring structure to form all or part of a ring.

Example 17

The refractory ring structure of any one of Examples 15-16, wherein at least one protrusion of the plurality of protrusions comprises a precast or monolithic shape or section.

Example 18

The refractory ring structure of any one of Examples 15-17, wherein at least one protrusion of the plurality of protrusions include a plurality of precast and/or monolithic shapes or sections.

Example 19

The refractory ring structure of any of Examples 15-18, wherein at least one protrusions of the plurality of protrusions comprises a precast and/or monolithic shape or section and is reinforced.

Example 20

A refractory ring structure for forming a section of an inner wall of a metallurgical vessel, the refractory ring structure comprising:

a continuous top surface;

a continuous bottom surface;

a continuous arcuate inner surface extending from the top surface to the bottom surface and defining a cavity; and a continuous arcuate outer surface opposite the inner surface and extending between the top surface and the bottom surface;

wherein the inner surface comprises a continuous protrusion intermediate the top surface and the bottom surface and extending a distance into the cavity; and wherein the refractory ring structure comprises a heat resistant, refractory material suitable for use in the inner wall of a metallurgical vessel.

Example 21

The refractory ring structure of Example 20, wherein the continuous protrusion is adapted to be contacted by a lifting device disposed in the cavity for lifting the refractory ring structure.

Example 22

The refractory ring structure of Examples 20 and 21, wherein all or a portion of the protrusion is structurally reinforced.

Example 23

The refractory ring structure of any of Examples 20-22, wherein the protrusions comprises a reinforcing member therein or thereon.

Example 24

The refractory ring structure of any of Examples 20-23, wherein the refractory ring structure comprises refractory bricks joined together with a bonding agent.

Example 25

The refractory ring structure of Example 24, wherein the bonding agent is a two-component epoxy compound, a refractory mortar, or other suitable adhesive.

Example 26

The refractory ring structure of any of Examples 20-25, wherein the refractory bricks are disposed in one of a spiral arrangement or a closed ring arrangement.

Example 27

The refractory ring structure of any of Examples 20-26, wherein the protrusion is formed by or includes one or more refractory bricks protruding from the inner surface into the cavity.

Example 28

The refractory ring structure of any of Examples 20-27, wherein the protrusion is formed by or includes one or more refractory bricks comprising a thickness dimension greater than a thickness dimension of adjacent refractory bricks in the refractory ring structure.

Example 29

The refractory ring structure of any of Examples 20-28, wherein the refractory ring structure comprises refractory bricks comprising of one or more of $Al_2O_3$, $SiO_2$, MgO, CaO, $Cr_2O_3$, alumina spinel, zirconium oxide, zircon and various forms of carbon as constituents, and wherein the refractory bricks are joined together with a bonding agent.

Example 30

The refractory ring structure of Examples 27, wherein at least one of the refractory bricks comprising the protrusions of the plurality of protrusions is structurally reinforced.

Example 31

The refractory ring structure of any of Examples 20-30, wherein the refractory ring structure comprises a precast shape or section and/or a monolithic shape or section.

Example 32

The refractory ring structure of any of Examples 20-30, wherein the refractory ring structure comprises a plurality of arcuate precast and/or monolithic shapes or sections arranged within the refractory ring structure to form all or part of a ring.

Example 33

The refractory ring structure of any one of Examples 20-32, wherein the protrusion includes one or more precast and/or monolithic shape or section.

Example 34

The refractory ring structure of any of examples 1-33, wherein the ring structure comprises a monolithic shape or section formed in the ring structure in situ.

Example 35

The refractory ring structure of any of examples 1-33, wherein the ring structure comprises a monolithic shape or section formed in the ring structure in situ using a ramming, shotcreting, and/or guniting technique.

Example 36

A metallurgical vessel comprising an inner refractory wall including at least one refractory ring structure as recited in any of Examples 1-35.

Example 37

A method for providing or replacing all or a section of a refractory inner wall or liner of a metallurgical vessel, the method comprising:

lifting the refractory ring structure of any of Examples 1-35 into a cavity defined by components of a metallurgical vessel; and positioning the refractory ring structure to form at least a portion of a refractory inner wall or liner of the metallurgical vessel.

Example 38

The method of Example 37, wherein lifting the refractory ring structure comprises contacting a surface or surfaces of a protrusion on the inner wall of the refractory ring structure with a lifting device and lifting the refractory ring structure.

Example 39

The method of any of Examples 37 and 38, wherein the lifting and positioning are repeated for a plurality of refractory ring structures according to any of Examples 1-33 to form at least a portion of the inner refractory wall or liner of the metallurgical vessel.

Example 40

The method of Example 39, further comprising applying a bonding agent or refractory mortar between the plurality of refractory ring structures.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system that "comprises," "has," "includes" or "contains" one or more elements possesses those one or more elements, but is not limited to possessing only those one or more elements. Likewise, an element of a system, device, or apparatus that "comprises," "has," "includes" or "contains" one or more features possesses those one or more features, but is not limited to possessing only those one or more features.

The terms "about" or "approximately" as used in the present disclosure, unless otherwise specified, means an acceptable error for a particular value as determined by one of ordinary skill in the art, which depends in part on how the value is measured or determined. In certain embodiments, the term "about" or "approximately" means within 1, 2, 3, or 4 standard deviations. In certain embodiments, the term "about" or "approximately" means within 50%, 20%, 15%, 10%, 9%, 8%, 7%, 6%, 5%, 4%, 3%, 2%, 1%, 0.5%, or 0.05% of a given value or range.

Any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. A replaceable refractory ring-shaped liner adapted for lifting and placement within a cavity of a metallurgical vessel to form a section of an inner wall of the metallurgical vessel, the ring-shaped liner comprising:

a continuous top surface;

a continuous bottom surface;

a continuous arcuate inner surface extending from the top surface to the bottom surface and defining a cavity, wherein the inner surface contacts material that is disposed within the metallurgical vessel; and a continuous arcuate outer surface opposite the inner surface and extending between the top surface and the bottom surface;

wherein the inner surface comprises a plurality of protrusions intermediate the top surface and the bottom surface and extending into the cavity;

wherein a plurality of spacings are defined between the protrusions of the plurality of protrusions; and wherein the ring-shaped liner comprises a heat resistant, refractory material and is configured to prevent passage of molten material through the inner surface to the outer surface.

2. The ring-shaped liner of claim 1, wherein the plurality of protrusions includes at least three protrusions.

3. The ring-shaped liner of claim 1, wherein the protrusions of the plurality of protrusions are disposed along the inner wall at generally the same elevation above the bottom surface.

4. The ring-shaped liner of claim 1, wherein each protrusion of the plurality of protrusions has a shape configured for contact with a lifting device configured for lifting the ring-shaped liner.

5. The ring-shaped liner of claim 1, wherein the ring-shaped liner comprises refractory bricks joined together with a bonding agent.

6. The ring-shaped liner of claim 1, wherein at least one protrusion of the plurality of protrusions comprises one or more refractory bricks protruding from the inner surface into the cavity.

7. The ring-shaped liner of claim 1, wherein at least one protrusion of the plurality of protrusions is formed by one or more refractory bricks comprising a thickness dimension greater than a thickness dimension of adjacent refractory bricks in the ring-shaped liner.

8. The ring-shaped liner of claim 1, wherein the ring-shaped liner comprises at least one of a precast shape and a monolithic shape.

9. The ring-shaped liner of claim 1, wherein at least one protrusion of the plurality of protrusions comprises at least one of a precast shape and a monolithic shape.

10. A replaceable refractory ring-shaped liner adapted for lifting and placement within a cavity of a metallurgical vessel to form a section of an inner wall of the metallurgical vessel, the ring-shaped liner comprising:

a continuous top surface;

a continuous bottom surface;

a continuous arcuate inner surface extending from the top surface to the bottom surface and defining a cavity, wherein the inner surface contacts material that is disposed within the metallurgical vessel; and a continuous arcuate outer surface opposite the inner surface and extending between the top surface and the bottom surface;

wherein the inner surface comprises a continuous protrusion intermediate the top surface and the bottom surface and extending into the cavity; and wherein the ring-shaped liner comprises a heat resistant, refractory material and is configured to prevent passage of molten material through the inner surface to the outer surface.

11. The ring-shaped liner of claim 10, wherein the continuous protrusion has a shape configured for contact with a lifting device configured for lifting the ring-shaped liner.

12. The ring-shaped liner of claim 10, wherein the ring-shaped liner comprises refractory bricks joined together with a bonding agent.

13. The ring-shaped liner of claim 10, wherein the protrusion comprises one or more refractory bricks protruding from the inner surface into the cavity.

14. The ring-shaped liner of claim 10, wherein the protrusion comprises one or more refractory bricks comprising a thickness dimension greater than a thickness dimension of adjacent refractory bricks in the ring-shaped liner.

15. The ring-shaped liner of claim 10, wherein the ring-shaped liner comprises at least one of a precast shape and a monolithic shape.

16. The ring-shaped liner of claim 10, wherein the protrusion comprises at least one of a precast shape and a monolithic shape.

17. A metallurgical vessel comprising an inner refractory wall including at least one ring-shaped liner as recited in claim 1.

18. A metallurgical vessel comprising an inner refractory wall including at least one ring-shaped liner as recited in claim 10.

19. A method for providing or replacing all or a section of a refractory inner wall or liner of a metallurgical vessel, the method comprising:

lifting a ring-shaped liner as recited in claim 1 into a cavity defined by components of a metallurgical vessel; and positioning the ring-shaped liner to form at least a portion of a refractory inner wall or liner of the metallurgical vessel.

20. The method of claim 19, wherein the lifting comprises contacting a surface of a protrusion on the inner wall of the ring-shaped liner with a lifting device and lifting the ring-shaped liner.

21. The method of claim 19, wherein the lifting and the positioning are repeated for a plurality of the ring-shaped liners to form at least a portion of the inner refractory wall or liner of the metallurgical vessel.

22. A method for providing or replacing all or a section of a refractory inner wall or liner of a metallurgical vessel, the method comprising:

lifting a ring-shaped liner as recited in claim 10 into a cavity defined by components of a metallurgical vessel; and positioning the ring-shaped liner to form at least a portion of a refractory inner wall or liner of the metallurgical vessel.

23. The method of claim 22, wherein the lifting comprises contacting a surface of the protrusion on the inner wall of the ring-shaped liner with a lifting device and lifting the ring-shaped liner.

24. The method of claim 22, wherein the lifting and the positioning are repeated for a plurality of the ring-shaped liners to form at least a portion of the inner refractory wall or liner of the metallurgical vessel.

25. The ring-shaped liner of claim 1, wherein at least one protrusion of the plurality of protrusions is reinforced.

26. The ring-shaped liner of claim 1, wherein at least one protrusion of the plurality of protrusions comprises an internal reinforcing member.

27. The ring-shaped liner of claim 10, wherein the continuous protrusion is reinforced.

28. The ring-shaped liner of claim 10, wherein the continuous protrusion comprises an internal reinforcing member.

29. The ring-shaped liner of claim 1, wherein the ring-shaped liner comprises at least one of refractory bricks and a precast material comprising one or more of $Al_2O_3$, $SiO_2$, MgO, CaO, $Cr_2O_3$, alumina spinel, zirconium oxide, zircon, and a carbon material.

30. The ring-shaped liner of claim 10, wherein the ring-shaped liner comprises at least one of refractory bricks and a precast material comprising one or more of $Al_2O_3$, $SiO_2$, MgO, CaO, $Cr_2O_3$, alumina spinel, zirconium oxide, zircon, and a carbon material.

31. The ring-shaped liner of claim 1, wherein all or part of the ring-shaped liner is formed by a process comprising at least one of casting, ramming, shotcreting, and guniting.

32. The ring-shaped liner of claim 10, wherein all or part of the ring-shaped liner is formed by a process comprising at least one of casting, ramming, shotcreting, and guniting.

33. A replaceable refractory ring-shaped liner adapted for lifting and placement within a cavity of a metallurgical vessel to form a section of an inner wall of the metallurgical vessel, the ring-shaped liner comprising:

a continuous top surface;

a continuous bottom surface;

a continuous arcuate inner surface extending from the top surface to the bottom surface and defining a cavity, wherein the inner surface contacts material that is disposed within the metallurgical vessel; and a continuous arcuate outer surface opposite the inner surface and extending between the top surface and the bottom surface;

wherein the inner surface comprises a plurality of protrusions intermediate the top surface and the bottom surface and extending into the cavity;

wherein a plurality of spacings are defined between the protrusions of the plurality of protrusions;

wherein the ring-shaped liner comprises a heat resistant, refractory material; and wherein the ring-shaped liner comprises refractory bricks joined together with a bonding agent.

34. The ring-shaped liner of claim 33, wherein at least one protrusion of the plurality of protrusions comprises one or more refractory bricks protruding from the inner surface into the cavity.

35. A replaceable refractory ring-shaped liner adapted for lifting and placement within a cavity of a metallurgical vessel to form a section of an inner wall of the metallurgical vessel, the ring-shaped liner comprising:

a continuous top surface;

a continuous bottom surface;

a continuous arcuate inner surface extending from the top surface to the bottom surface and defining a cavity, wherein the inner surface contacts material that is disposed within the metallurgical vessel; and a continuous arcuate outer surface opposite the inner surface and extending between the top surface and the bottom surface;

wherein the inner surface comprises a continuous protrusion intermediate the top surface and the bottom surface and extending into the cavity;

wherein the ring-shaped liner comprises a heat resistant, refractory material; and wherein the ring-shaped liner comprises refractory bricks joined together with a bonding agent.

36. The ring-shaped liner of claim 35, wherein at least one protrusion of the plurality of protrusions comprises one or more refractory bricks protruding from the inner surface into the cavity.

* * * * *